US009807531B2

(12) United States Patent
Yoo et al.

(10) Patent No.: US 9,807,531 B2
(45) Date of Patent: Oct. 31, 2017

(54) MICROPHONE AND METHOD OF MANUFACTURING A STRUCTURE FOR DELAYING THE PHASE OF SOUND INPUT

(71) Applicant: Hyundai Motor Company, Seoul (KR)

(72) Inventors: Ilseon Yoo, Seoul (KR); Hyunsoo Kim, Seoul (KR); Yong Sung Lee, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 51 days.

(21) Appl. No.: 14/852,574

(22) Filed: Sep. 13, 2015

(65) Prior Publication Data

US 2016/0150326 A1 May 26, 2016

(30) Foreign Application Priority Data

Nov. 26, 2014 (KR) ..... 10-2014-0166784

(51) Int. Cl.

| | |
|---|---|
| ***H04R 17/02*** | (2006.01) |
| ***H04R 19/00*** | (2006.01) |
| ***H04R 31/00*** | (2006.01) |
| ***H04R 19/04*** | (2006.01) |

(52) U.S. Cl.

CPC ..... *H04R 31/00* (2013.01); *H04R 17/02* (2013.01); *H04R 19/005* (2013.01); *H04R 19/04* (2013.01); *H04R 2201/003* (2013.01)

(58) Field of Classification Search

CPC ... H04R 23/00; H04R 31/00; H04R 2201/003
See application file for complete search history.

(56) References Cited

U.S. PATENT DOCUMENTS

| | | | | |
|---|---|---|---|---|
| 2,504,456 A * | 4/1950 | Rundell | ..... | G10K 1/071 84/404 |
| 8,467,548 B2 | 6/2013 | Karunasiri et al. | | |
| 8,541,852 B2 * | 9/2013 | Kasai | ..... | G01H 11/06 257/415 |

(Continued)

FOREIGN PATENT DOCUMENTS

| | | | |
|---|---|---|---|
| JP | 58043700 A | * | 3/1983 |
| JP | 2013-110581 A | | 6/2013 |

(Continued)

*Primary Examiner* — Md S Elahee
*Assistant Examiner* — Angelica M McKinney
(74) *Attorney, Agent, or Firm* — Mintz Levin Cohn Ferris Glovsky and Popeo, P.C.; Peter F. Corless

(57) ABSTRACT

A microphone and a method of manufacturing the microphone are provided. The method includes; preparing a substrate and forming a vibrating membrane having an oxide film and a plurality of slots onto the substrate. A sacrificial layer and a fixed membrane is formed over the vibrating membrane and air intake apertures are formed through the fixed membrane. A first pad is connected to the fixed membrane, a second pad is connected to the vibrating membrane, and a phase delay unit is bonded to the bonding pad. A penetration aperture may be formed by etching the rear side of the substrate and bonding the phase delay unit on the bonding pad. A sound passage, is formed by connecting passage patterns, and sound apertures with the sound passages by sequentially stacking phase delay layers on the bonding pad and simultaneously forming the passage patterns in the phase delay layers.

9 Claims, 11 Drawing Sheets

(56) References Cited

U.S. PATENT DOCUMENTS

| | | | | |
|---|---|---|---|---|
| 2003/0118203 | A1* | 6/2003 | Raicevich | H04R 19/00 381/174 |
| 2007/0201710 | A1* | 8/2007 | Suzuki | B81B 3/0072 381/174 |
| 2009/0161894 | A1 | 6/2009 | Kimura | |
| 2010/0022046 | A1* | 1/2010 | Utsumi | B81C 1/00896 438/51 |
| 2010/0142742 | A1 | 6/2010 | Tanaka et al. | |
| 2011/0075865 | A1* | 3/2011 | Yang | H04R 19/005 381/174 |
| 2015/0060955 | A1* | 3/2015 | Chen | H04R 19/005 257/254 |

FOREIGN PATENT DOCUMENTS

| | | | |
|---|---|---|---|
| KR | 10-0640199 | B1 | 11/2006 |
| KR | 10-0740462 | B1 | 7/2007 |
| KR | 10-1089828 | B1 | 12/2011 |
| KR | 10-2013-0060932 | A | 6/2013 |
| KR | 20-2013-0003418 | U | 6/2013 |

* cited by examiner

MICROPHONE AND METHOD OF MANUFACTURING A STRUCTURE FOR DELAYING THE PHASE OF SOUND INPUT

CROSS-REFERENCE TO RELATED APPLICATION

This application claims priority to and the benefit of Korean Patent Application No. 10-2014-0166784 filed in the Korean Intellectual Property Office on Nov. 26, 2014, the entire contents of which are incorporated herein by reference.

BACKGROUND (a) Field of the Invention

The present invention relates to a microphone and a method of manufacturing the microphone and particularly, to a microphone having improved sensitivity by a structure of delaying the phase of sound input.

(b) Description of the Related Art

In general, microphones, which convert sound into an electrical signal, have been increasingly downsized, and accordingly, a microphone using an Micro Electro Mechanical System (MEMS) has been developed. Such a MEMS further resists humidity and heat, as compared with the Electret Condenser Microphone (ECMs) of the related art, and can be downsized and integrated with a signal processing circuit.

Generally, the MEMS microphone is either a capacitive MEMS microphone or a piezoelectric MEMS microphone. For example, the capacitive MEMS microphone includes a fixed membrane and a vibrating membrane, thus when a sound pressure is applied to the vibrating membrane from the outside, the gap between the fixed membrane and the vibrating membrane changes and the capacitance changes accordingly. The sound pressure is measured based on an electrical signal generated during the process.

Additionally, the piezoelectric MEMS microphone includes a vibrating membrane. When the vibrating membrane is deformed by external sound pressure, an electrical signal is generated by the piezoelectric effect and the sound pressure is measured.

The MEMS microphone is classified into a non-directional (omnidirectional) microphone and a directional microphone based on the directionality, and the directional microphone is classified into a bidirectional microphone and a unidirectional microphone. In particular, the bidirectional is configured to receive sounds from both the front and back, but attenuates sounds from sides, so it has a ribbon polar pattern for sound.

Further, the bidirectional microphone has an improved near field effect, so it is generally used by announcers at stadiums with substantial noise. Conversely, the unidirectional microphone is configured to maintain output in response to sound from the front, but offsets output for sound from the back, to improve the Signal to Noise (S/N) ratio for the sound from the front. Accordingly, the bidirectional microphone produces clear sound and is generally used for equipment for recognizing voice. However, the directional MEMS microphones are costly due to two or more digital MEMS microphones and Digital Signal Processing (DSP) chips.

The above information disclosed in this section is merely for enhancement of understanding of the background of the invention and therefore it may contain information that does not form the prior art that is already known in this country to a person of ordinary skill in the art.

SUMMARY

The present invention provides a microphone and method of manufacturing a microphone which may be downsized by a phase delay membrane made of a wafer level package, and may include more precise directionality.

An exemplary embodiment of the present invention provides a method of manufacturing a microphone that may include preparing a substrate and then forming a vibrating membrane having an oxide film and a plurality of slots onto the substrate; forming a sacrificial layer and a fixed membrane over the vibrating membrane. Then forming air intake apertures through the fixed membrane; depositing a first pad to be connected with the fixed membrane, a second pad to be connected with the vibrating membrane, and a bonding pad on which a phase delay unit is bonded; forming a penetration aperture by etching the rear side of the substrate; and bonding the phase delay unit on the bonding pad. The bonding of a phase delay unit, a sound passage, may be formed by connecting passage patterns, and sound apertures may be connected with the sound passages may be formed by sequentially stacking phase delay layers on the bonding pad and simultaneously by forming the passage patterns in the phase delay layers.

In the forming of a phase delay unit, the sound apertures may be formed through top and bottom sound apertures. Additionally, in the forming of a phase delay unit, the bottom sound aperture may be connected with the air intake apertures. The bonding pad and the phase delay layers may include a polymer SU-8 material. Furthermore, in the forming of a passage, the sound passage may be formed in a substantially zigzag shape.

The forming of air intake apertures may include forming a plurality of first and second recessions on the top of the sacrificial layer and the top of the fixed membrane, respectively; and forming a plurality of projections on the bottom of the fixed membrane. The projections may be positioned at the first recessions of the sacrificial layer.

Another exemplary embodiment of the present invention provides a method of manufacturing a microphone which may include preparing a substrate and then forming a vibrating membrane having an oxide film and a plurality of slots onto the substrate; forming a sacrificial layer and a fixed membrane over the vibrating membrane and then forming air intake apertures through the fixed membrane; depositing a first pad connected with the fixed membrane and a second pad connected with the vibrating membrane; forming a penetration aperture by etching the rear side of the substrate; and bonding a phase delay unit on the fixed membrane. The bonding of a phase delay unit may include forming a sound passage by etching the phase delay layer with a Phot Resist (PR) patterning as a mask on the phase delay layer. Additionally, the method may include forming passages for the first pad and the second pad, and sound aperture by etching the phase delay layer with the PR patterning as a mask on the rear side of the phase delay layer, after turning the phase delay layer up and down.

In the forming of a phase delay unit, a sound passage with a predetermined pattern may be formed in the phase delay layer and sound apertures may be formed to be connected with the sound passage. The forming of air intake apertures may include: forming a plurality of first and second recessions on the top of the sacrificial layer and the top of the fixed membrane, respectively. The forming of air intake apertures may further include forming a plurality of projections on the bottom of the fixed membrane. The projections may be positioned at the first recessions of the sacrificial layer.

In another exemplary embodiment, a microphone may include a vibrating membrane having a plurality of slots and disposed on the substrate. The microphone may further include a fixed membrane disposed at a predetermined distance over the vibration membrane and having a plurality of air intake apertures. A phase delay unit may be disposed on the fixed membrane and may have a sound aperture through which sound may travel inside from the exterior and a sound passage therein that is connected with sound aperture.

The sound aperture may be formed at the top and the bottom of the phase delay unit. In addition, the sound aperture at the bottom may be connected with the air intake apertures. The sound passage may be formed in a zigzag shape and connected with the sound apertures at the top and the bottom. The sound passage may have a substantially circular shape when the phase delay unit is viewed from above.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION OF THE EMBODIMENTS

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, In order to make the description of the present invention clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween.

An exemplary embodiment of the present invention will hereinafter be described in detail with reference to the accompanying drawings.

Figure 1:
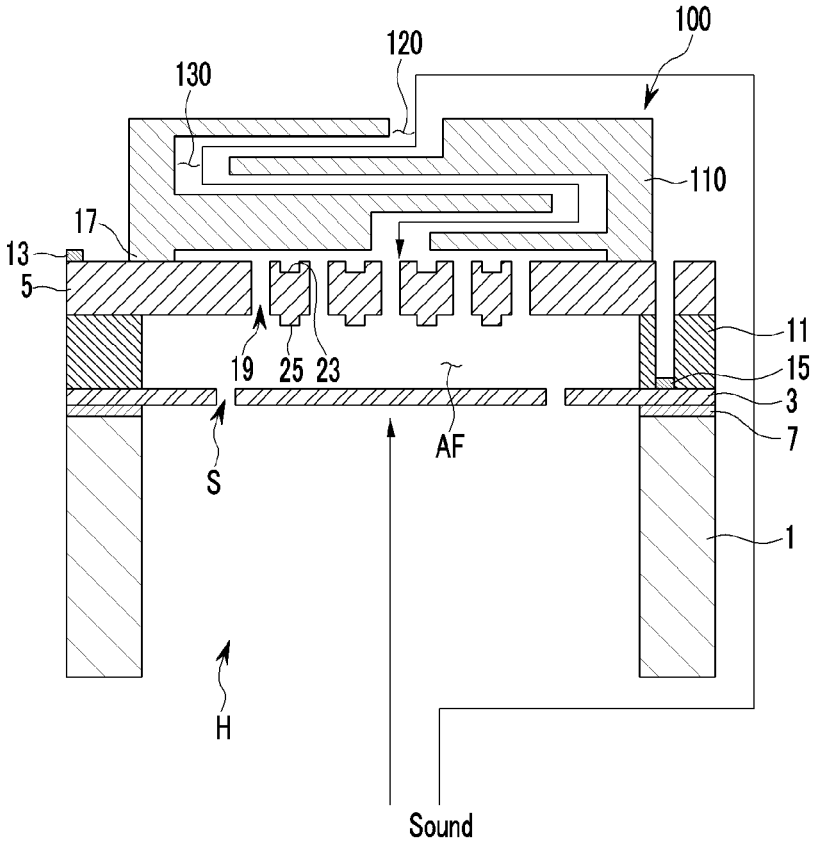
FIG. 1 is an exemplary cross-sectional view showing a microphone according to an exemplary embodiment of the present invention.

FIG. 1 is an exemplary cross-sectional view of a microphone according to an exemplary embodiment of the present invention. Referring to FIG. 1, a microphone according to an exemplary embodiment of the present invention may include a substrate 1, a vibrating membrane 3, a fixed membrane 5, and a phase delay unit 100. The substrate 1 may be made of silicon and may cover a penetration aperture H. The vibrating membrane 3 may be partially exposed by the penetration aperture H and the portion of the vibrating membrane 3 exposed by the penetration aperture H may vibrated by sound. Furthermore, the vibrating membrane 3 may have at least one slot S. In addition, the slot S may improve the sensitivity of the microphone by reducing influence due to air damping when the vibrating membrane 3 is vibrated by exterior.

The term 'air damping' means suppressing vibration of the vibrating membrane 3 due to air by absorbing vibration. In other words, the sensitivity of the microphone may be improved by attenuating the vibration of the vibrating membrane 3 due to air, but receiving only the vibration due to sound. The vibrating membrane 3 may be made of polysilicon, but it is not limited thereto and may be made of any materials as long as they have conductivity.

The fixed membrane 5 may be disposed under the vibrating membrane 3 and may have a plurality of air intake apertures 19. The fixed membrane 5 may be configured to be supported and fixed by a support layer 11. The support layer 11 may be disposed along the edge on the top of the vibrating membrane 3 and may be formed by etching a portion of a sacrificial layer 9 to be described below. The fixed membrane 5 may have a plurality of second recessions 23 on the top and a plurality of projections 25 on the bottom.

The projections 25 may protrude toward the vibrating membrane 3, and may prevent contact between the vibrating membrane 3 and the fixed membrane 5, when the vibrating membrane 3 vibrates. The fixed membrane 5 may be made of polysilicon or metal. An air layer AF may be formed between the vibrating membrane 3 and the fixed membrane 5, to dispose the membranes at a predetermined distance from each other. According to this structure, exterior sound may travel inside through the air intake apertures 19 of the fixed membrane 5 and contacts the vibrating membrane 3, to cause the vibrating membrane 3 to vibrate. In other words, as the vibrating membrane 3 is vibrated by exterior sound, the gap between the vibrating membrane 3 and the fixed membrane 5 may change Therefore, the capacitance between the vibrating membrane 3 and the fixed membrane 5 may change and the changed capacitance may be converted into an electrical signal by a signal processing circuit (not shown) through a first pad 13 connected to the fixed membrane 5 and a second pad 15 connected to the vibrating membrane 3, to thus sense exterior sound.

The phase delay unit 100 may be bonded by a bonding pad 17 on the fixed membrane 5. The phase delay unit 100 may include a plurality of phase delay layers 110 sequentially stacked with passage patterns inside. The phase delay unit may have a sound passage formed by connecting the passage patterns and a sound aperture connected with the sound passage. The sound apertures may include top and bottom sound apertures, and the top and bottom sound apertures may be the etched portions at the top and the bottom of the phase delay layers, respectively. The top sound apertures may function as a passage through which exterior sound may travel. The bottom sound apertures may be connected to the air intake apertures.

The phase delay unit 100, may extend the time for the input sound to reach the vibrating membrane, and delay the phase of sound by guiding the input sound through the sound passage 130. The bonding pad 17 and the phase delay layer 110 may be made of a polymer material which may include SU-8.

Figure 2:
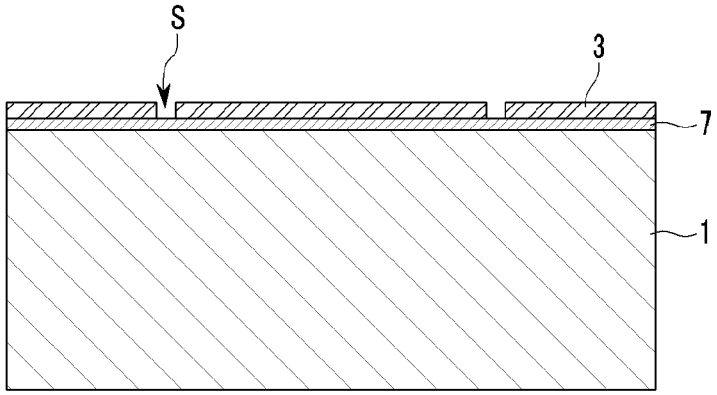
FIGS. 2 to 5 are exemplary diagrams showing a basic method of manufacturing the microphone according to an exemplary embodiment of the present invention.

FIGS. 2 to 5 are exemplary embodiments of diagrams showing a basic method of manufacturing the microphone according to an exemplary embodiment of the present invention. Referring to FIG. 2, the substrate 1 may be prepared and then an oxide film 7 may be formed on the substrate 1. Next, a step of forming the vibrating membrane 3 with the slots S on the oxidation film 7 may be performed. The substrate 1 may be made of silicon and the vibrating membrane 3 may be made of polysilicon or a conductive material.

The vibrating membrane 3 with the slots S may be formed by forming a polysilicon layer or a conductive material layer on the oxide film 7 and then patterning the layer. In other words, the vibrating membrane 3 with the slots S may be formed by forming a polysilicon layer or a conductive material layer on the oxide film 7 and then forming a photosensitive layer on the polysilicon layer or the conductive material layer. Further, a photosensitive pattern may be formed by exposing and developing the photosensitive layer and the etching the polysilicon layer or the conductive material layer with the photosensitive layer pattern as a mask.

Figure 3:
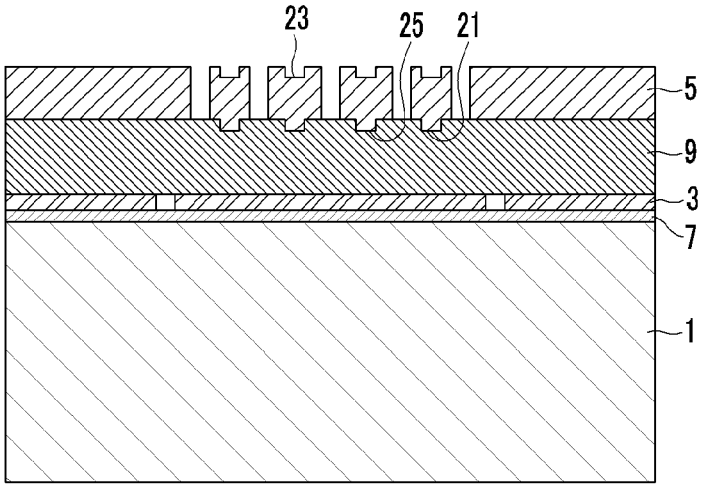

Referring to FIG. 3, the sacrificial layer 9 and the fixed membrane 5 may be formed over the vibrating membrane 3. Next, a step of forming the air intake apertures 19 through the fixed membrane 5 may performed. The sacrificial layer 9 may be made of a photosensitive substance, a silicon oxide, or a silicon nitride. The fixed membrane 5 may be made of polysilicon or metal. The sacrificial layer 9 may have a plurality of first recessions 21. The fixed membrane 5 may have a plurality of second recessions 23 on the top and a plurality of projections 25 on the bottom. The projections 25 may protrude toward the vibrating membrane 3. The sacrificial layer 9 and the fixed membrane 5 may be formed to fit the projections 25 in the first recessions 21. Accordingly, the projections 25 may prevent contact between the vibrating membrane 3 and the fixed membrane 5, when the vibrating membrane 3 vibrates.

Further, for the air intake apertures 19, a photosensitive layer may be formed on the fixed membrane 5 and then a photosensitive pattern may be formed by exposing and developing the photosensitive layer. Then, the fixed membrane may be etched with the photosensitive layer pattern as a mask.

Figure 4:
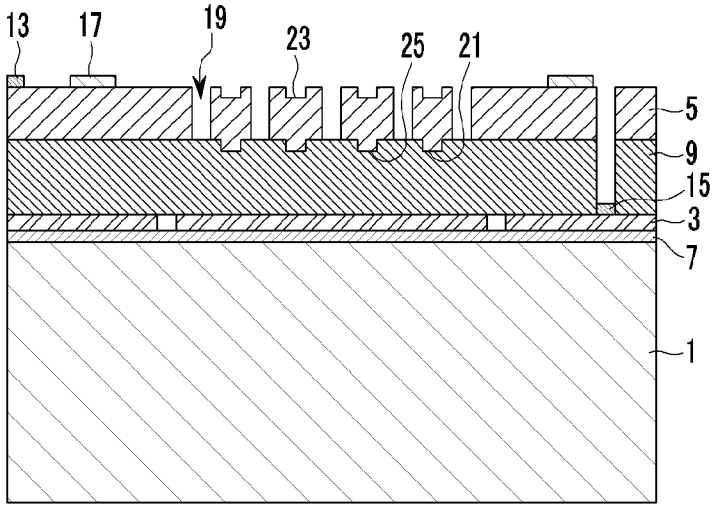

Referring to FIG. 4, a step of depositing the first pad 13 may be connected with the fixed membrane 5, the second pad 15 may be connected with the vibrating membrane 3, and the bonding pad 17 for bonding the phase delay unit 100 may be performed. The second pad 15 may be formed on an exposed portion of the vibrating membrane 3, after the fixed membrane 5 and the sacrificial layer 9 is partially removed to expose the vibrating membrane 3. The first pad 13, the second pad 15, and the bonding pad 17 may be formed using a lift-off method.

Figure 5:
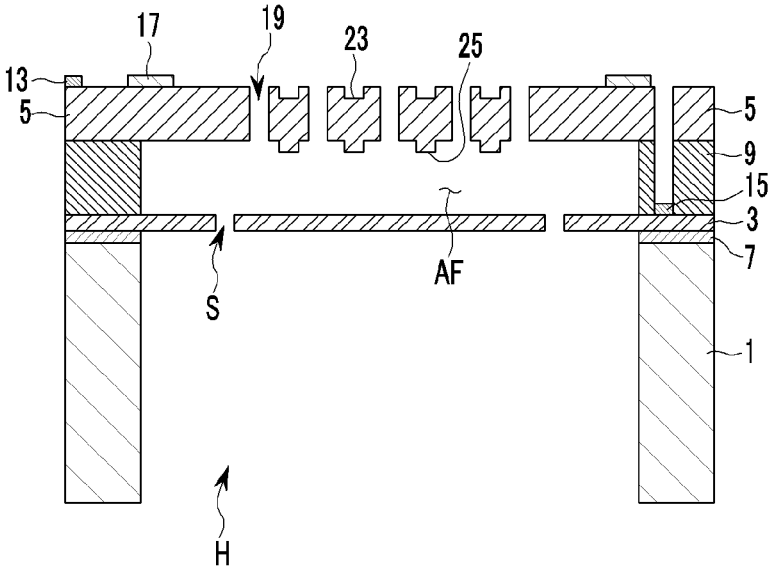

Referring to FIG. 5, a step of forming the penetration apertures H by etching the rear side of the substrate 1 and of forming the air layer AF between the vibrating membrane 3 and the fixed membrane 5 by partially etching the oxide film 7 and the sacrificial layer 9 may be performed. First, the penetration apertures H may be formed by performing dry etching or wet etching on the rear side of the substrate 1. When the rear side of the substrate 1 is etched, a portion of the vibrating membrane 3 may be exposed by etching the oxide film 7. Further, the support layer 11 supporting the fixed membrane 5 may be formed by etching a portion of the sacrificial layer 9. The support layer 11 may be positioned along the edge of the top of the vibrating membrane 3 and may support and fix the fixed membrane 5.

The air layer AF may be formed by removing a portion of the sacrificial layer 9 by wet etching that uses etchant through the air intake apertures 19. Further, the air layer AF may be formed by dry etching, such as ashing using oxygen plasma, through the air intake apertures 19. For example, a portion of the sacrificial layer 9 may be removed by wet etching or dry etching, to form the air layer AF between the vibrating membrane 3 and the fixed membrane 5. The remaining sacrificial layer 9 may be positioned along the edge of the vibrating membrane 3, as the support layer 11 supporting the fixed membrane 5.

Figure 6:
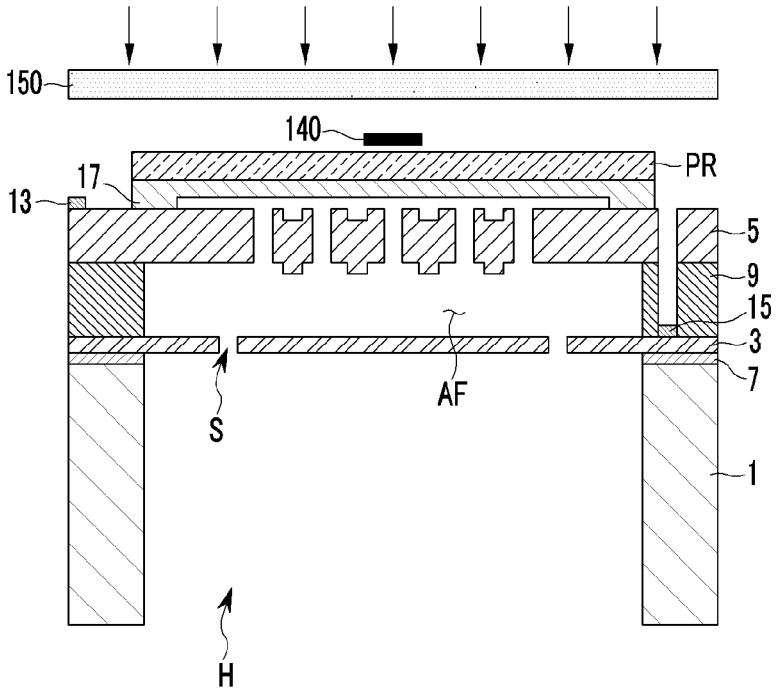
FIGS. 6 to 8 are exemplary diagrams showing a method of manufacturing a phase delay unit according to an exemplary embodiment of the present invention.
Figure 7:
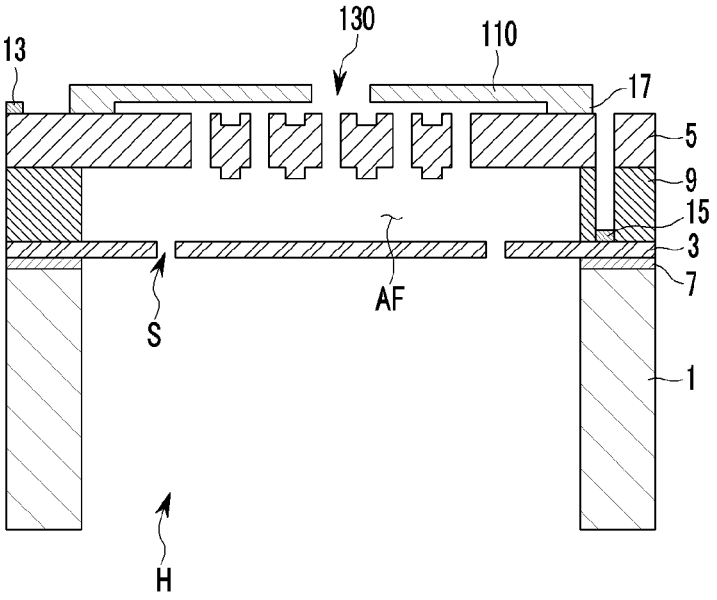
Figure 8:
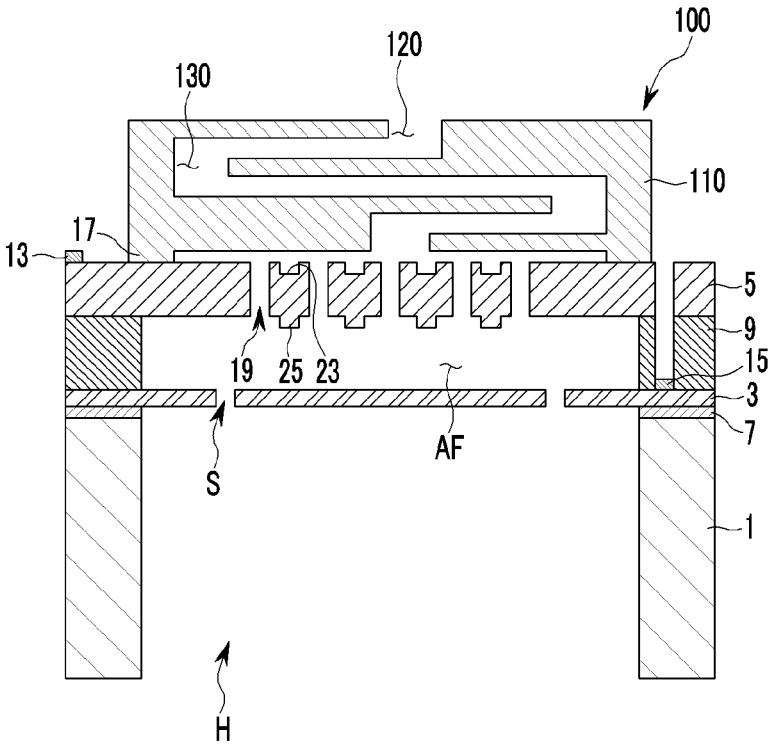

A process of manufacturing the phase delay unit 100 for delaying the phase of sound is described hereafter based on the manufacturing process described above. For example, FIGS. 6 to 8 are exemplary diagrams showing a method of manufacturing a phase delay unit according to an exemplary embodiment of the present invention. Referring to FIGS. 6 and 7, the phase delay layer 110 may be formed first on the bonding pad 17. Next, a PR may be formed on the phase delay layer 110 and a light blocking layer may be formed over the PR, at the portion to be etched of the phase delay layer 110. A step of radiating light to the PR through a transmissive layer 150 over the light blocking layer 140 may be performed. Thereafter, the etched vibrating membrane 3 may remain by removing the PR.

Referring to FIG. 8, a step of stacking phase delay layers by repeating the processes shown in FIGS. 6 and 7 seven times may be performed. Although etching the phase delay layers 110 may be performed seven times in an exemplary embodiment of the present invention, the present invention is not limited thereto and the number of times of etching the phase delay layer 110 may be changed, if necessary.

For example, the etched portions of the stacked phase delay layers 110 may be connected, therefore the sound passage 130 may be formed. The phase delay unit 100 may have the sound aperture 120 connecting the sound passage 130 to the exterior. The sound aperture 120 may include the top sound aperture 120 and the bottom sound aperture 120. In particular, the top and bottom sound apertures 120 may be the etched portions of the top and bottom phase delay layers 110 of the phase delay unit 100. For example, the top sound aperture 120, may be the etched portion of the top phase delay layer 110 of the phase delay unit 100, and may be configured to receive exterior sound. The bottom sound aperture may be the etched portion of the bottom phase delay layer 110 of the phase delay unit 100, may be connected with the air intake apertures 19 and may be configured to transmit sound with a delayed phase to the vibrating membrane 3. In other words, when exterior sound travels inside through the top sound aperture 120 of the phase delay unit 110, the sound travels through the bottom sound aperture 120, with the phase delayed through the sound passage 130, and then reaches the vibrating membrane 3. As described above, the sound apertures 120 and the sound passage 130 delay the phase of exterior sound.

Figure 9:
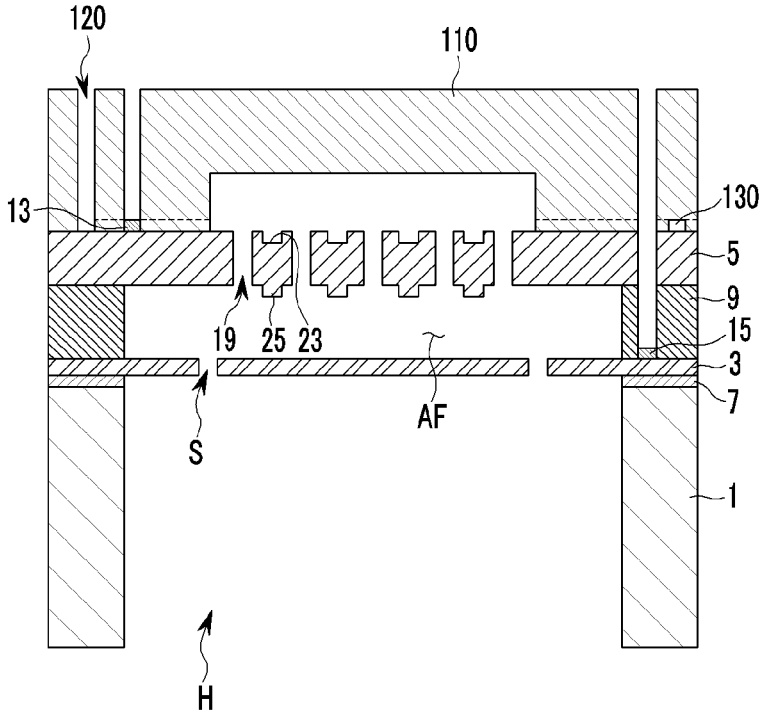
FIG. 9 is an exemplary cross-sectional view of a microphone according to another exemplary embodiment of the present invention.
Figure 10:
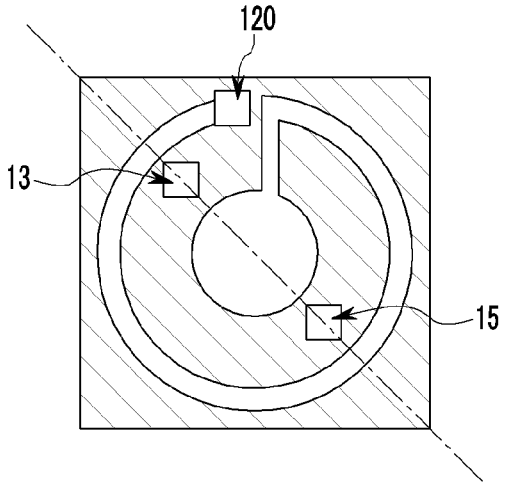
FIG. 10 is an exemplary top plan view showing the microphone according to another exemplary embodiment of the present invention.

FIG. 9 is an exemplary cross-sectional view showing a microphone according to another exemplary embodiment of the present invention and FIG. 10 is an exemplary top plan view showing the microphone according to another exemplary embodiment of the present invention. Referring to FIGS. 9 and 10, the microphone according to another exemplary embodiment of the present invention, based on the processes shown in FIGS. 2 to 5, includes a phase delay unit having a structure different from that in the previous exemplary embodiment. However, the step of forming the bonding pad 17 is not included.

The phase delay unit 100 of the microphone according to another exemplary embodiment of the present invention may have a substantially circular sound passage, as viewed from above. For example, in the microphone according to another exemplary embodiment, when exterior sound travels inside through the top sound aperture 120 of the phase delay unit 100, the sound passes through the sound passage 130 connected with the top sound aperture 120 and then reaches the vibrating membrane 3 through the bottom sound aperture 120.

Figure 11A:
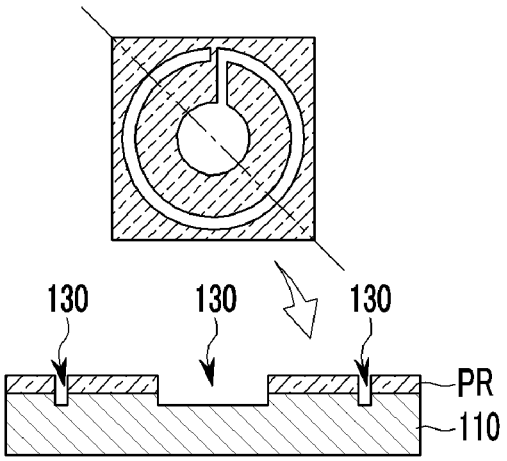
FIGS. 11A-11D are exemplary diagrams illustrating a method of manufacturing a phase delay unit according to another exemplary embodiment of the present invention.

A process of manufacturing the phase delay unit 100 according to another exemplary embodiment is described with respect to FIGS. 11A-11D. For example, FIGS. 11A-11D are an exemplary diagrams illustrating a method of manufacturing a phase delay unit according to another exemplary embodiment of the present invention. Referring to FIG. 11A, first, a step of forming a phase delay layer 110, forming a PR patterning on a side of the phase delay layer 110, and then forming a sound passage 130 by etching the phase delay layer 110 with the PF patterning as a mask may be performed. (S1)

Figure 11B:
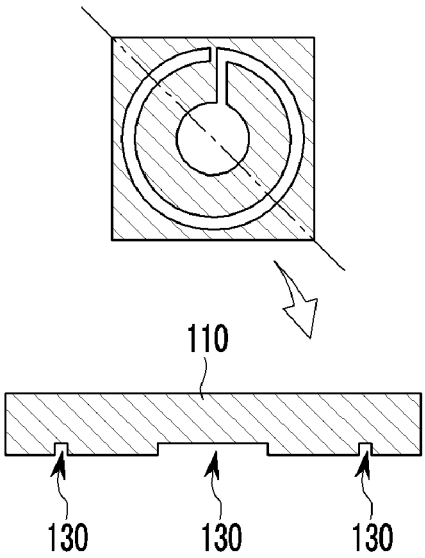
Figure 11C:
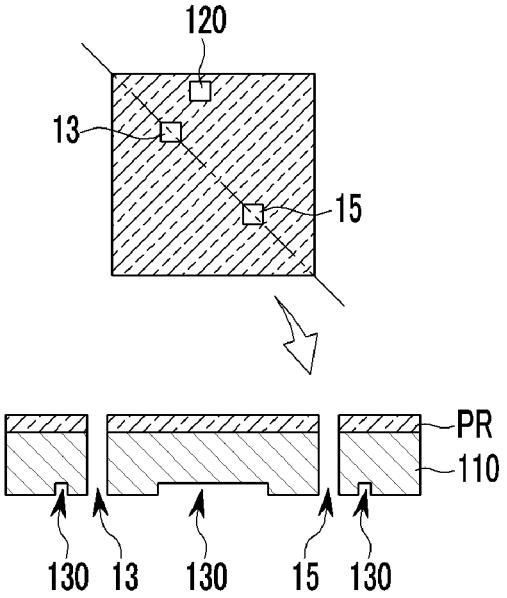
Figure 11D:
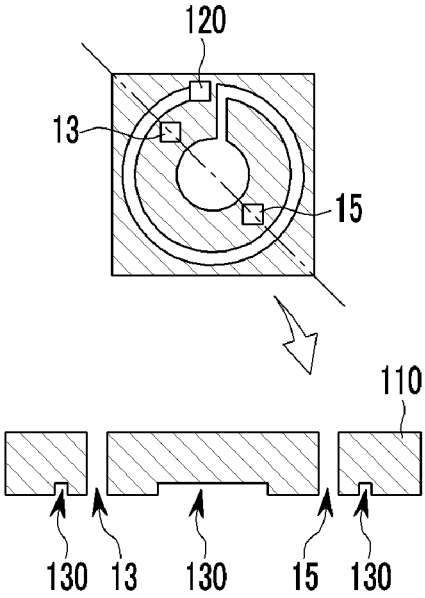

As shown in FIG. 11B, a step of turning the phase delay layer up and down 110 after removing the PR patterning may be performed. (S2) As further shown in FIG. 11C, a step of forming a PR patterning on the other side of the phase delay layer 110 and forming a aperture for a first pad 13 connected with a fixed membrane 5, a aperture for a second pad 15 connected with a vibrating membrane 3, and a sound apertures 120 by etching may be performed. (S3) Finally, as shown in FIG. 11D, a step of bonding the phase delay unit 100 on the fixed membrane 5 by removing the PR patterning in S3 FIG. 11C may be performed. (S4) In some embodiments, the phase delay layer 110 may be a silicon wafer.

Therefore, since the sound passage 130 may be formed and exterior sound traveling into the sound apertures 12 reaches the vibrating membrane 3 through the sound passage 130, the phase delay unit 100 according to an exemplary embodiment of the present invention may improve the effect of delaying sound. As described above, according to an exemplary embodiment the size of the device may be reduced using a wafer level package. Further, according to an exemplary embodiment, since a phase delay layer having a passage may be formed, sound requires more time to reach a device, thereby improving the sensitivity of the microphone. According to an exemplary embodiment digital processing may be omitted and directionality may be be achieved by analog processing, thus reducing cost for an ASIC.

While this invention has been described in connection with what is presently considered to be practical exemplary embodiments, it is to be understood that the invention is not limited to the disclosed exemplary embodiments, but, on the contrary, is intended to cover various modifications and equivalent arrangements included within the spirit and scope of the appended claims.

What is claimed is:

1. A method of manufacturing a microphone, comprising:

preparing a substrate and forming a vibrating membrane having an oxide film and a plurality of slots onto the substrate;

forming a sacrificial layer and a fixed membrane over the vibrating membrane and forming air intake apertures through the fixed membrane;

depositing a first pad to be connected with the fixed membrane, a second pad to be connected with the vibrating membrane, and a bonding pad on which a phase delay unit is bonded;

forming a penetration aperture by etching a rear side of the substrate;

bonding the phase delay unit on the bonding pad;

forming a sound passage, by connecting passage patterns, and sound apertures connected with the sound passage, such that the sound passage is formed by sequentially stacking phase delay layers on the bonding pad and simultaneously by forming the passage patterns in the phase delay layers.

2. The method of claim 1, wherein in the forming of the phase delay unit, the sound apertures are formed through top and bottom sound apertures.

3. The method of claim 1, wherein the bonding pad and the phase delay layers include a polymer SU-8 material.

4. The method of claim 1, wherein: the sound passage is formed in a zigzag shape.

5. The method of claim 1, wherein the forming of air intake apertures includes:

forming a plurality of first and second recessions on a top of the sacrificial layer and a top of the fixed membrane, respectively; and forming a plurality of projections on a bottom of the fixed membrane, and wherein the projections are positioned at the first recessions of the sacrificial layer.

6. The method of claim 2, wherein in the forming of the phase delay unit, the bottom sound aperture is connected with the air intake apertures.

7. A method of manufacturing a microphone, comprising:

preparing a substrate and forming a vibrating membrane having an oxide film and a plurality of slots onto the substrate;

forming a sacrificial layer and a fixed membrane over the vibrating membrane and forming air intake apertures through the fixed membrane;

depositing a first pad to be connected with the fixed membrane and a second pad to be connected with the vibrating membrane;

forming a penetration aperture by etching a rear side of the substrate; and bonding a phase delay unit on the fixed membrane, wherein the bonding of the phase delay unit includes:

forming a sound passage by etching a plurality of phase delay layers with a photoresist (PR) patterning as a mask on the phase delay layers such that the sound passage is formed by sequentially stacking the phase delay layers; and forming passages for the first pad and the second pad, and sound apertures by etching the phase delay layers with the PR patterning as a mask on a rear side of the phase delay layers, after turning the phase delay layers up or down.

8. The method of claim 7, wherein in the forming of the phase delay unit, the sound passage with a predetermined pattern is formed in the phase delay layer and the sound apertures to be connected with the sound passage.

9. The method of claim 7, wherein the forming of air intake apertures includes:

forming a plurality of first and second recessions on a top of the sacrificial layer and a top of the fixed membrane, respectively; and forming a plurality of projections on a bottom of the fixed membrane, wherein the projections are positioned at the first recessions of the sacrificial layer.

* * * * *